United States Patent [19]

Kalla

[11] Patent Number: 4,469,363

[45] Date of Patent: Sep. 4, 1984

[54] FIREWOOD CARRIER

[76] Inventor: Alec K. Kalla, Rte. 1, Box 140 B, Conifer, Colo. 80433

[21] Appl. No.: 327,484

[22] Filed: Dec. 4, 1981

Related U.S. Application Data

[63] Continuation of Ser. No. 224,745, Jan. 13, 1981, abandoned.

[51] Int. Cl.[3] ..... A45C 71/00

[52] U.S. Cl. ..... 294/154; 294/157

[58] Field of Search ..... 294/154, 157, 149, 152, 294/74, 147, 156, 151, 153, 170

[56] References Cited

U.S. PATENT DOCUMENTS

| | | | |
|---|---|---|---|
| 1,699,114 | 1/1929 | Meagher | 294/157 |
| 3,119,160 | 1/1964 | Hoppeler | 294/157 |
| 3,143,266 | 8/1964 | Imatake | 294/154 |

*Primary Examiner*—James B. Marbert
*Attorney, Agent, or Firm*—John E. Reilly

[57] ABSTRACT

A firewood carrier is comprised of a continuous length of rope having a series of spaced intersecting portions which are retained together in parallel relation to one another by deformable plastic tubular spreaders in surrounding relation to the intersection portions such that opposite ends of the spreaders are bounded by opposite sides of the rope. The free ends of the rope are passed through the closed or loop end of the rope to form an object-encircling portion in which the firewood can be stacked so that when the free or handle end is lifted the object-encircling portion is contracted into snug fitting engagement with the firewood with opposite sides of the rope engaging longitudinally spaced locations around the stack of firewood.

7 Claims, 3 Drawing Figures

FIREWOOD CARRIER

This application is a continuation of Ser. No. 224,745, filed Jan. 13, 1981, now abandon for FIREWOOD CARRIER, by Alec K. Kalla.

This invention relates to article carriers, and more particularly relates to a novel and improved sling-type carrier which is adaptable for stacking and transportation of elongated objects, such as, firewood.

BACKGROUND AND FIELD OF THE INVENTION

Sling-type carriers have been devised in the past for use in the bundling, transportation or storage of logs and similarly shaped articles. Customarily, carriers are made up of one or more elongated flexible members formed into a generally loop-shaped configuration with the free ends secured to a common connector and an opposite, closed end either connected to or passed through the connector to form an object-encircling portion. Thus, when the logs are stacked within the object-encircling portion and the carrier is lifted by means of the handle, the weight of the logs will cause the object-encircling portion to be tightened around the logs so as to facilitate their transportation from one point to another without shifting or accidental removal of any of the logs. Representative of this approach is U.S. Letters Pat. No. 1,699,114 to Meagher which discloses a sling-type carrier in which the closed end of the flexible member is passed through a ring which secures together the free ends of the flexible member and the closed or looped end can then be engaged by a suitable hook or other lifting tool. Other U.S. Letters patent which typify this approach are U.S. Pat. Nos. 3,119,160 to Hoppeler and 1,325,025 to Linnertz.

The patent to Meagher also proposes the use of spreader bars spaced at intervals along the length of a flexible member intermediately between the connected end and looped end, the spreaders or stretchers being held in position by pins which are driven through openings formed adjacent to opposite ends of the stretchers whereby to wedgingly engage the flexible member in its passage through the openings.

Other U.S. Letters patents of interest are U.S. Pat. No. 398,902 to Payne which shows a wood carrier consisting of two base-wires and a bail; U.S. Pat. No. 515,353 to McIntosh, Sr. which illustrates a combined woodbox, kindling and ash receptacle that is a combination of base, pan and oil reservoir; U.S. Pat. No. 625,927 to Hanson et al. which discloses a wood holder and carrier constructed of metal wire and composed of wire bails, upper crossbar provided with handle, pan and wire grating; U.S. Pat. No. 1,027,401 to Check, which shows a wood carrier composed of wire, hinges, eyes and other relatively rigid components arranged into a hinged, collapsible wood carrier having a curved carrying handle composed of relatively rigid material; and U.S. Pat. No. 3,827,614 to Baxter et al. which illustrates a single wall tubular packaging carrier constructed of flexible material, open at both transverse ends and provided with a handle disposed adjacent to a longitudinal edge, affixed thereto by sewing.

It has also been proposed to use devices which consist of a piece of fabric or leather approximately rectangular in shape, with handles of wood or fabric disposed adjacent to each of two opposite ends. Other prior art in the field comprehends either rigid, complicated devices; or devices which are difficult to load and unload; also, devices that do not sufficiently stabilize a bundle of wood during the transportation of the wood, or are fairly limited in carrying capacity.

SUMMARY OF THE INVENTION

It is therefore an object of the present invention to provide for a novel and improved carrier to facilitate bundling, transportation and storage of elongated objects, such as, logs in a greatly simplified but reliable and efficient manner.

It is another object of the present invention to provide for a novel and improved wood carrier of the sling type which is constructed of rope or other flexible tendon-like members in combination with spreaders which encircle and compact a bundle of wood at spaced locations around the circumference of the bundle so as to prevent the wood from shifting or being displaced from the carrier.

It is an additional object of the present invention to provide for a novel and improved sling-type carrier which can be constructed using a single length of rope together with a novel and improved method and means for affixing spreaders to the rope so that the spreaders are held in position by friction but can be adjusted to different positions without removal from the rope.

It is still another object of the present invention to provide for a novel and improved sling-type carrier which includes a visual indicator of overweight loading by virtue of the novel means of affixing spreaders to the carrier so that the carrier will visibly deform the mouths or ends of the spreaders; and further wherein the carrier is collapsible, flexible, inexpensive, easily manufactured and assembled while being capable of securely carrying varying quantities of wood or other articles.

In accordance with the present invention, a sling carrier is of the type having an elongated flexible tendon member doubled upon itself to define opposite sides of substantially equal length which extend from a common closed end and terminate in opposite free ends, the opposite sides criss-crossing one another to define intersecting portions at uniformly spaced intervals along the substantial length thereof. Securing means for each of the intersecting portions are operative to secure the intersecting portions together in parallel, contiguous relation to one another so as to define transversely extending rungs of predetermined width, the free ends of the assembled carrier returned back through the closed end to define a generally loop-shaped, object-encircling portion for the placement of firewood therein. In a preferred embodiment of the present invention, the carrier is constructed of rope and flexible tubular spreaders in such a manner that a bundle of wood can be carried by encircling it in a modified cowhitch knot. Opposite sides of the rope are passed through the spreaders so as to form the rope into a series of loops or rungs arranged in a ladder-like configuration, the spreaders frictionally retained in surrounding relation to the intersecting portions such that opposite ends of the spreaders are bounded by opposite sides of the flexible member. The last spreader may serve as the handle end by securing the terminal ends of the flexible member just outwardly of the last spreader; and, when the handle end is passed through the opposite closed end of the flexible member, an object-encircling portion is formed for stacking of the wood or other articles. The handle end may be manually lifted or lifted by other suitable apparatus as a result of which the object-encircling portion will be contracted into firm engagement with the objects stacked therein, the spreaders assuring that the opposite sides of the flexible member will engage the stack at spaced points along its length so as to assure most uniform distribution of the load.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 3:
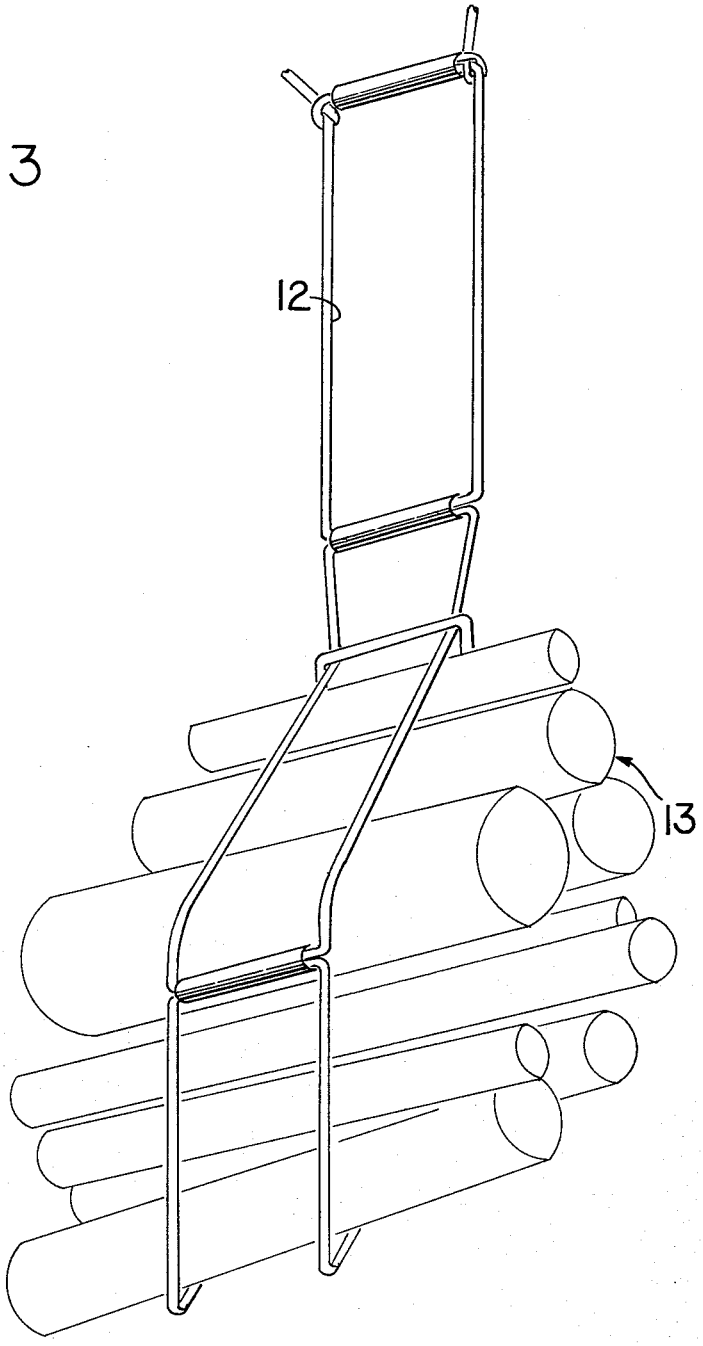
FIG. 3 is a somewhat perspective view illustrating the use of the carrier of the present invention in lifting a stack of logs.

Referring in more detail to the drawings, a sling-type carrier generally designated at 12 is particularly adaptable for use in lifting and storage of a bundle of firewood or logs as generally designated at 13 in FIG. 3. The carrier is broadly comprised of a flexible tendon member which may suitably be formed of a single continuous length of multi-strand rope which is doubled upon itself and has free ends 1 and 4 and an opposite closed end 5. The flexible tendon member is crisscrossed upon itself a number of times to define intersecting portions which are enclosed or encased within a plurality of spreaders 2, 6, 8 and 9. For the purpose of illustration but not limitation, the rope may be on the order of 13′ in length and made up of a conventional three-strand rope. In turn, the spreaders may be correspondingly made up of ½″ nominal inside diameter flexible plastic tubing, of a type commonly employed as a water conduit, three of which act as spreaders, as represented at 2, 6 and 8, and the fourth spreader 9 serving as a handle. Preferably, each of the spreaders is on the order of 4″ in length.

The spreaders 2, 6, 8 and 9 are assembled onto the flexible tendon member in the following manner: The free end 1 of the member is pushed through a first spreader 2 until the free end 1 extends beyond an end 3 of the spreader tube; opposite free end 4 of the flexible member is then inserted into the end 3 of the spreader tube from which the other end 1 extends, and the end 4 is passed through the spreader 2 until it projects beyond the end of the spreader opposite to the end 3. The free ends 1 and 4 of the flexible tendon member are pulled through the spreader 2 until a loop portion or closed end 5 is formed and which may be of a length of approximately 2½′. By virtue of the relative size of the flexible tendon member or rope and the spreader 2, the spreader 2 is frictionally retained in place on the intersecting portions of the rope enclosed by the tubing or spreader so that the spreader is retained against accidental slipping or movement but can be positively adjusted.

The free ends 1 and 4 are then successively inserted through a second spreader 6 in the same manner as described with respect to the spreader 2 and positioned, by pulling the ends through the tubing as needed, so that the spreader 6 is parallel to the first spreader tube. Typically, the length of the opposite sides 7 of the rope between spreaders 2 and 6 is on the order of 1′ with the free ends 1 and 4 extending equally from opposite ends of the second spreader 6. In this relation, the longitudinal axes of the spreaders 2 and 6 are perpendicular to the opposite sides 7 of the rope. The procedure is once again repeated by advancing the free ends 1 and 4 through a third spreader 8 and which is positioned in spaced parallel relation to the spreaders 2 and 6, the opposite sides 7 formed between the spreaders 6 and 8 corresponding in length to those between the spreaders 2 and 6. The free ends 1 and 4 are then passed through spreader 9 in the same manner as described with reference to the spreaders 2, 6 and 8. While this procedure may be repeated any number of times depending upon the desired effective length of the carrier and the number of spreaders employed therealong, for the purpose of illustration, the spreader 9 is the last spreader to be assembled onto the carrier and therefore serves as the handle end. Thus, once the ends 1 and 4 are drawn through the last spreader 9 with the desired spacing or distance established between the spreaders as described, the ends will extend approximately 5″ beyond the end of the spreader 9. In order to secure the spreader 9 in place, each rope end 1 and 4 is tied into a suitable knot, such as, a half-hitch knot which is secured around the terminal ends 10 and 11 of opposite sides of the rope entering the spreader 9. These knots are then tightened until they are firmly secured against the opposite ends of the spreader 9.

Figure 1:
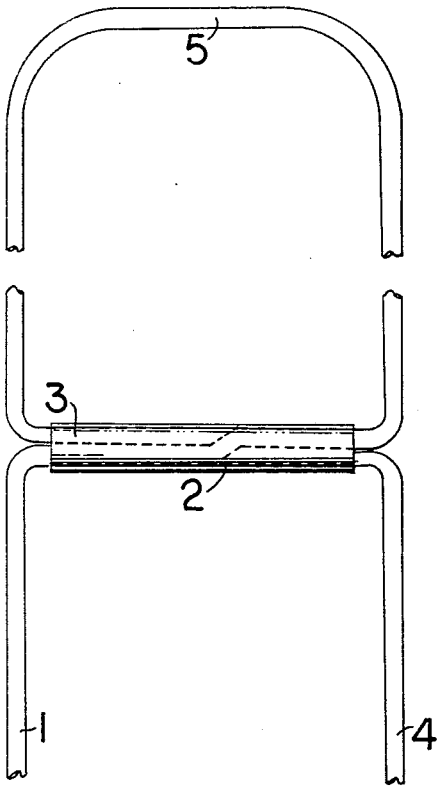
FIG. 1 is a somewhat fragmentary view illustrating the initial assembly of a preferred form of sling carrier in accordance with the present invention.
Figure 2:
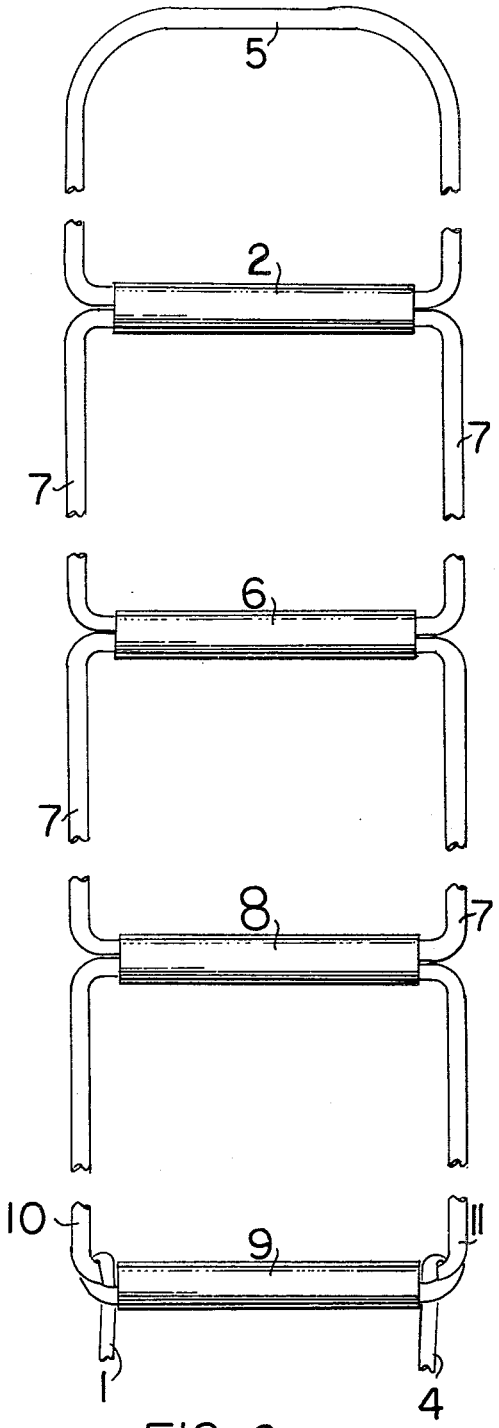
FIG. 2 is an elevational view of the preferred form of sling carrier assembled in accordance with the present invention.

Once assembled as described, the carrier 12 is in the form of a rope ladder, as shown in FIG. 2 of the drawings, with a spreader/handle 9 at one end of the device and a closed end or loop 5 at the opposite end. In practice, the carrier 12 is placed on the ground and extended until the opposite sides 7, 10 and 11 of the flexible tendon member are relatively straight, as illustrated in FIG. 2. The spreaders 2, 6, 8 and 9 serve to maintain the spacing between the rails or sides 7, 10 and 11 so that pieces of wood 13 may be placed upon the carrier with the long axes of the wood 13 perpendicular to the longitudinal axes of the rails 7, 10 and 11. Both the handle end 9 and loop end 5 of the carrier are lifted from the ground and drawn together around the stack of wood 13 whereupon the handle 9 is passed through the loop end 5. The loop end 5 is then released to slide along the opposite sides or rails 7, 10 and 11 as the handle end 9 is lifted away from the ground, all as illustrated in FIG. 3.

The carrier 12 now effectively forms an object-encircling portion around the wood which is in the form of a cow-hitch knot which both encircles and compacts the bundle of wood as the handle is lifted and the entire bundle raised above the ground for transportation purposes. If lesser quantities of wood are to be carried, more than one of the spreaders 2, 6, 8 and 9 can be grasped in the hands as handles so as to shorten the distance above the ground when the carrier is lifted in order to carry the wood. The carrier may quickly release the stack of wood by setting the carrier upon the ground and passing the handle 9 back through the closed end 5 so as to permit removal of the wood.

From the foregoing it will be appreciated that the spreaders are particularly effective in serving as reinforcing elements while maintaining the desired spaced relationship between opposite sides of the flexible tendon member so as to engage the wood in spaced locations and improve the stability of the carrier. In this relation, the opposite sides or rails 7, 10 and 11 project beyond opposite ends of the spreader so that when tightened around a bundle of wood or other articles will virtually preclude any movement or slippage of the wood. Moreover, the tubular spreaders will afford at opposite ends a visual indication of overloading by exhibiting visible deformation at the ends in the event that the load is too great.

It is therefore to be understood that various modifications and changes in the construction and arrangement of parts and sequence of steps employed in the preferred form of invention may be made without departing from the spirit and scope of the present invention as defined by the appended claims.

I claim:

1. In a sling carrier, an elongated, flexible tendon member doubled upon itself to define opposite sides of substantially equal length extending from a common closed end and terminating in opposite free ends, said opposite sides criss-crossing one another to define intersecting portions at spaced intervals, and securing means for each of said intersecting portions, each securing means operative to secure said intersecting portions together in parallel, contiguous relation to one another so as to define transversely extending spreader members of predetermined width, said free ends of said tendon member looped under and extending beyond said closed end to define a generally loop-shaped carrier for the placement of elongated objects therein.

2. In a carrier according to claim 1, said securing means defined by generally tubular connectors, each connector encircling said intersecting portions of said tendon member.

3. In a carrier according to claim 2, said tubular connectors being of uniform length, each connector encircling one of said intersecting portions and being frictionally engaged by said intersecting portions, said connectors disposed at equally spaced intervals along the substantial length of said carrier.

4. In a carrier according to claim 1, including a handle adjacent to said opposite free ends of said tendon member.

5. In a carrier according to claim 2, said tubular connectors being of uniform length and spaced to maintain opposite sides of said tendon member between said intersecting portions in spaced parallel relation to one another.

6. In a carrier according to claim 1, said tendon member being in the form of a rope, said opposite sides of said rope projecting beyond opposite ends of said securing means, and free ends of said rope having knots outwardly at opposite ends of one of said securing means to define a handle.

7. In a carrier according to claim 1, said spreader members each composed of a deformable plastic material whereby to act as an overload indicator when said carrier is lifted.

* * * * *

UNITED STATES PATENT AND TRADEMARK OFFICE

CERTIFICATE OF CORRECTION

PATENT NO. : 4,469,363

DATED : September 4, 1984

INVENTOR(S) : Alec K. Kalla

It is certified that error appears in the above—identified patent and that said Letters Patent is hereby corrected as shown below:

In the Abstract:

Line 5, cancel "intersection" and substitute -- intersecting --.

In the Specification:

Column 1, line 34, cancel "patent" and substitute -- Patent --.
Column 1, line 45, cancel "patents" and substitute -- Patents --.
Column 1, line 51, cancel "al." and substitute -- al --.
Column 1, line 59, cancel "al." and substitute -- al --.

In the Claims:

Claim 6, Column 6, line 25, cancel "at" and substitute -- of --.

Signed and Sealed this

*Twenty-sixth* Day of *February 1985*

[SEAL]

*Attest:*

DONALD J. QUIGG

*Attesting Officer* *Acting Commissioner of Patents and Trademarks*